United States Patent [19]

Yuge et al.

[11] Patent Number: 4,887,130

[45] Date of Patent: Dec. 12, 1989

[54] ELECTROSTATIC LATENT IMAGE DEVELOPING APPARATUS

[75] Inventors: Shizuo Yuge; Kouji Matsushita, both of Toyokawa; Hidetoshi Kawabata, Toyohashi, all of Japan

[73] Assignee: Minolta Camera Kabushiki Kaisha, Osaka, Japan

[21] Appl. No.: 234,071

[22] Filed: Aug. 12, 1988

Related U.S. Application Data

[63] Continuation of Ser. No. 915,571, Oct. 6, 1986, abandoned.

[30] Foreign Application Priority Data

Oct. 7, 1985 [JP] Japan ..... 60-224255

[51] Int. Cl.[4] ..... G03G 15/09

[52] U.S. Cl. ..... 355/251; 118/657; 355/260

[58] Field of Search ..... 355/3 DD, 14 D, 245, 355/251, 253, 260, 215; 118/657, 658; 430/122

[56] References Cited

U.S. PATENT DOCUMENTS

| | | | |
|---|---|---|---|
| 3,003,462 | 10/1961 | Streich, Sr. | 118/657 |
| 3,828,730 | 8/1974 | Yamashita et al. | 118/658 |
| 3,939,801 | 2/1976 | Tanaka et al. | 118/658 |
| 3,999,514 | 12/1976 | Abbott et al. | 118/657 |
| 4,026,241 | 5/1977 | Takebe et al. | 118/658 X |
| 4,030,477 | 6/1977 | Takahashi et al. | 118/658 |
| 4,168,901 | 9/1979 | Ito et al. | 355/3 DD |
| 4,177,757 | 12/1979 | Murakawa et al. | 118/658 |
| 4,338,880 | 7/1982 | Tabuchi et al. | 118/652 |
| 4,436,803 | 3/1984 | Ikeda et al. | 118/658 X |
| 4,492,456 | 1/1985 | Haneda et al. | 355/3 DD |
| 4,525,056 | 6/1985 | Itaya et al. | 118/658 X |
| 4,545,325 | 10/1985 | Komatsu et al. | 118/658 X |
| 4,563,978 | 1/1986 | Nakamura et al. | 118/658 |
| 4,592,653 | 6/1986 | Ikeda et al. | 355/3 DD |
| 4,615,608 | 10/1986 | Mizutani | 118/658 X |
| 4,638,760 | 1/1987 | Nakamura et al. | 118/658 |
| 4,660,958 | 4/1987 | Egami et al. | 430/122 X |
| 4,675,266 | 6/1987 | Fujiwara et al. | 118/657 X |

FOREIGN PATENT DOCUMENTS

| | | |
|---|---|---|
| 56-161634 | 12/1981 | Japan . |
| 56-161654 | 12/1981 | Japan . |

*Primary Examiner*—Fred L. Braun

*Attorney, Agent, or Firm*—Wenderoth, Lind & Ponack

[57] ABSTRACT

An electrostatic latent image developing apparatus has a magnet housed in a developing sleeve and having at least one magnetized portion including adjacent poles of the same polarity. At least one of the poles of the magnetized portion is opposed to the casing of the developing apparatus, between the position where the developing sleeve is opposed to an electrostatic latent image bearing member and the position where the sleeve is opposed to a developer agitating roller. The other pole adjacent to and having the same polarity as this pole is positioned downstream from the pole with respect to the direction of rotation of the sleeve. Consequently, the upstream pole of the magnetized portion acts to retain a portion of developer between the developing sleeve and the casing, whereby the toner is prevented from spilling over the casing.

4 Claims, 2 Drawing Sheets

ELECTROSTATIC LATENT IMAGE DEVELOPING APPARATUS

This application is a continuation of now abandoned application Ser. No. 06/915,571, filed Oct. 6, 1986 now abandoned.

BACKGROUND OF THE INVENTION

1. Field of the Invention

The present invention relates to an electrostatic latent image developing apparatus for visualizing making visible electrostatic latent images formed on the surface of an electrostatic latent image bearing member by an electrophotographic process.

2. Description of the Prior Art

Developing apparatus has already been provided which comprises a developing sleeve made of aluminum or the like and having a magnetic roller fixedly positioned within the sleeve, and a developer agitating roller (such as a bucket roller or screw roller) drivingly rotatable for supplying a developer to the outer periphery of the sleeve. The developing sleeve is adapted to support the developer thereon and to transport the developer to a developing station which is opposed to an electrostatic latent image bearing member and at which an electrostatic latent image formed on the surface of the bearing member is developed to a visible image.

In such developing apparatus, the developing sleeve is generally accommodated in a casing shaped in conformity with the shape of the developing sleeve, with a predetermined clearance formed between the casing and the sleeve surface as disclosed, for example, in U.S. Pat. No. 3,999,514.

If the clearance is excessively large, some particles released from the mass of developer by being subjected to a mechanical stress by the agitation of the developer agitating roller or the like will spill out from the apparatus through the clearance. Conversely, if the clearance is too small, the developer clogs the clearance between the developing sleeve and the casing to overflow from the apparatus or to result in an increased torque necessary for the rotation of the developing sleeve.

Accordingly, the clearance between the developing sleeve and the casing needs to be accurately adjusted to a value approximately equal to the height of bristles of the developer supported on the sleeve.

However, since the casing is in the form of an integral resin molding or an assembly of molded resin members which are adhered together, the casing maybe twisted or distorted, and it is impossible to space it from the sleeve by a uniform clearance and therefor there exist the problems of spillage of the developer, clogging and an increase in the rotational torque of the sleeve.

SUMMARY OF THE INVENTION

The main object of the present invention is to provide an electrostatic latent image developing apparatus free of the foregoing drawbacks and capable of giving satisfactory copy images without fog, spots or other faults.

Another object of the present invention is to provide an electrostatic latent image developing apparatus which is free of the likelihood that the developer will spill out from the apparatus to stain neighboring devices or adhere to the electrostatic latent image bearing member.

The above and other objects of the present invention can be fulfilled by an electrostatic latent image developing apparatus which comprises a developing sleeve drivingly rotatable for supplying a magnetic developer to the surface of an electrostatic latent image bearing member, developer supplying means opposed to the developing sleeve for supplying the developer to the surface of the developing sleeve, a casing covering the developing sleeve and disposed between the position where the sleeve surface is opposed to the surface of the image bearing member and the position where the sleeve surface is opposed to the developer supplying means with respect to the direction of rotation of the developing sleeve, and a magnet fixedly positioned within the developing sleeve and having at least one magnetized portion, the magnetized portion including a pole opposed to the casing and another pole having the same polarity as said pole and adjacent to said pole at the downstream side thereof with respect to the direction of rotation of the developing sleeve, the magnet having a plurality of N and S poles extending axially of the sleeve and including said poles.

DETAILED DESCRIPTION OF THE INVENTION

The present invention will be described below with reference to the drawings showing an embodiment.

Figure 1:
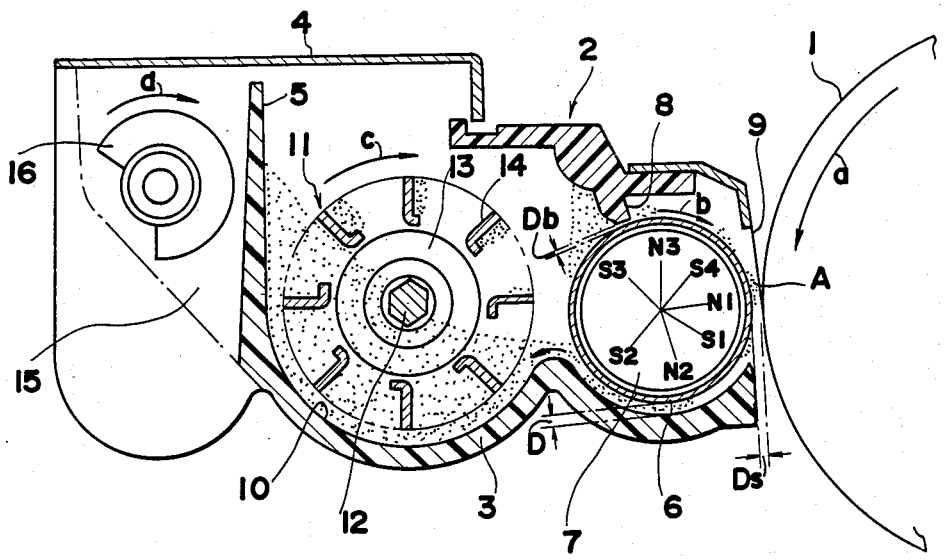
FIG. 1 is a sectional view showing an electrostatic latent image developing apparatus embodying the present invention.

FIG. 1 shows a photosensitive drum 1 and a developing apparatus 2 embodying the invention. The developing apparatus 2 comprises a developing sleeve 6, an agitating roller 11 and a supply roller 16 which are accommodated in a space defined by a casing 3 and a cover 4. These components 6, 11 and 16 are arranged one after another rearward away from the drum 1.

The photosensitive drum 1 is in the form of a hollow cylinder having an organic photosensitive surface layer for forming thereon an electrostatic latent image when light is projected on the drum surface from an unillustrated optical system. The drum 1 is drivingly rotatable at a circumferential speed of 150 mm/sec in the direction of arrow a.

The developing sleeve 6 is in the form of a hollow cylinder made of an electrically conductive nonmagnetic material (such as aluminum). The sleeve 6 has minute surface irregularities formed by sandblasting, is opposed to the drum 1 and spaced therefrom by a developing gap Ds of 0.6 mm, and is drivingly rotatable at a speed of 14.64 r.p.m. in the direction of arrow b.

The developing sleeve 6 has a magnetic roller 7 fixedly positioned therein and provided with magnetic poles in its outer periphery. A developer (usually in the form of a mixture of carrier and toner) is supported on the outer periphery of the sleeve 6 by the magnetic force of the roller 7 and is transported to a developing station A opposed to the drum 1. At this station A, the electrostatic latent image formed on the drum 1 is developed.

A clearance D of 1.0 mm is formed between the lower portion of the developing sleeve 6 and the casing 3.

The magnetic roller 7 has an outside diameter of 24.5 mm has poles N1–N3 and S1–S4 arranged alternately along its outer periphery, except that the poles S2 and S3 of the same polarity are adjacent to each other and positioned below and above the side portion of the magnetic roller 7 opposite to the developing station A and most proximate to the agitating roller 11. The magnetic pole S2 is positioned upstream from the above-mentioned roller side portion with respect to the direction of transport of the developer by the sleeve 6, i.e., to the direction of rotation of the the sleeve 6, and is opposed to the casing 3. Thus, the pole S3 adjacent to the pole S2 is positioned downstream therefrom.

Figure 2:
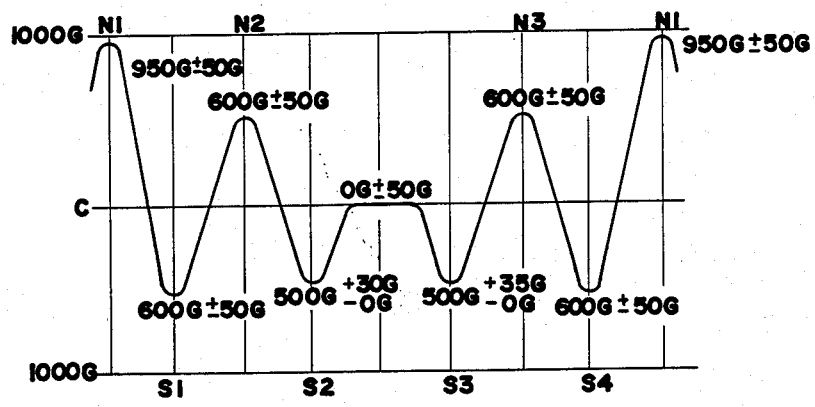
FIG. 2 is a diagram showing the magnetic force of poles formed in a magnetic roller.

As seen in FIG. 2, the poles N1–N3 and S1–S4 have magnetic forces of: 950 G for N1, 600 G for N2, N3, S1, S4, and 500 G for S2, S3, although these values are not limitative.

The agitating roller 11 is a bucket roller which comprises an agitating member having blades 13 and is mounted on a shaft 12 and which has an outside diameter of 34 mm. The agitating roller 11 is provided in a developer agitation-transport channel (hereinafter referred to as an "agitation channel") 10 and is drivingly rotatable in the direction of arrow c at 179.55 r.p.m. to transport the developer within the agitation channel 10 toward one end thereof (remote from the plane of FIG. 1) by the blades 13 while mixing and agitating the developer therewith and to supply portions of the developer to the surface of the developing sleeve 6 by buckets 14.

The supply roller 16 is a screw roller provided in a developer supply-transport channel 15 (hereinafter referred to as a "supply channel") which is defined by a partition 5 disposed to the rear of the agitating roller 11. The supply roller 14 transports the developer within the supply channel 15 toward one end thereof (near the plane of FIG. 1) while mixing and agitating the developer with a supply of toner from an unillustrated toner replenishing container.

The partition 5 has a passage at each of its near and remote ends (with respect to the plane of FIG. 1) for holding the agitation channel 10 in communication with the supply channel 15. The developer transported through the agitation channel 10 to its remote end by the agitating roller 11 is transferred to the supply channel 15 through the remote passage, then transported through the channel 15 to its near end by the supply roller 16 and sent into the agitation channel 10 again through the near passage.

The casing 3 is provided at an upper portion thereof with a bristle height restricting plate 8 which is opposed to the developing sleeve 6 and spaced therefrom by a bristle height restricting gap Db of 0.5 mm. The plate 8 regulates the amount of developer to be transported by cutting off the ends of bristles of the developer being transported by the sleeve 6.

Indicated at 9 is a toner confining sheet made of a polyurethane film (0.1 mm in thickness) and attached to the casing 3 at the upper portion thereof opposed to the photosensitive drum 1. The sheet 9 is adapted to prevent the toner released from around the developing sleeve 6 from scattering upward.

In the developing apparatus 2 of the foregoing construction, the developer is mixed and agitated while being transported through the supply channel 15 and the agitation channel 10 by the supply roller 16 and the agitating roller 11 and also while being replenished with toner from the unillustrated toner container. Consequently, the toner is fed, as charged to a higher potential, to the surface of the developing sleeve 6 by the agitating roller 11.

Figure 3:
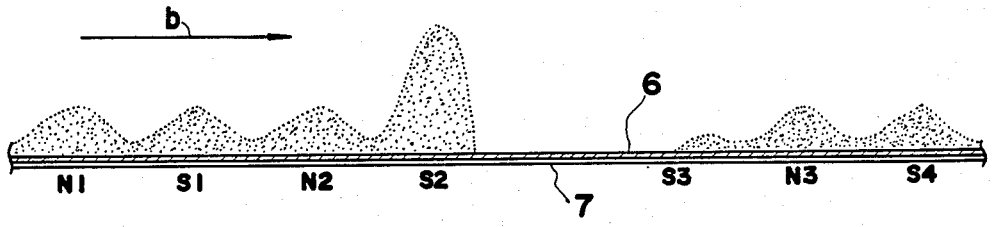
FIG. 3 is a developed view of a developing sleeve showing a developer as supported thereon.

FIG. 3 shows the developer as magnetically attracted to the surface of the developing sleeve 6 during the operation of the apparatus 2. More specifically, FIG. 3 schematically shows the developing sleeve 6 only in development during rotation, as removed from the the developing apparatus 2, to illustrate the state of the developer thereon. The diagram reveals that although bristles of varying heights are formed in accordance with the magnetic force of the pole except at the portion magnetized to provide the adjacent poles S2 and S3 of the same polarity, the bristle of the developer formed above the pole S2 is exceedingly higher than the others. This has been ascertained by experiments.

Accordingly, when the magnetic roller 7 is so positioned as to oppose the pole S2 to the casing 3 as seen in FIG. 1, the developer bristle formed at the position of the pole S2 has its height regulated by the casing 3. It is especially noted that the developer portion positioned outward is lower in density and less restrained magnetically. Consequently, the developer opposed to the pole S2 spreads sidewise and acts to seal the clearance D between the sleeve 6 and the casing 3.

The developer is supplied to the developing sleeve 6 and delivered therefrom in the manner to be described below with reference to FIG. 1.

The developer remaining on the surface of the sleeve 6 and having its toner content reduced by passing through the developing station A is transported upward from below on the rear side of the sleeve 6 opposite to the station A, released from the magnetic force upon passing over the pole S2 and removed from the sleeve surface.

The developer removed from the sleeve 6 is forced toward the agitating roller 11 and mixed with the developer in the agitation channel 10 by the agitating roller 11.

On the other hand, the portion of developer sent forward by a bucket 14 of the agitating roller 11 is supplied onto the developing sleeve 6 in the vicinity of the pole S3 of the magnetic roller 7, transported by the sleeve 6 in the direction of arrow b and used for development.

Even if the developer is subjected to a stress by the agitating and transporting action of the agitating roller 11, permitting separation of some toner from the carrier, the pole S2 retains a portion of developer between the developing sleeve 6 and the casing 3 to produce a sealing effect, whereby the separated toner is prevented from spilling out. Further since the developer is merely in contact with the casing 3 at the position of the pole S2, it is unlikely that the developer will clog up the clearance between the sleeve 6 and the casing 3 or result in an increased torque for the rotation of the sleeve 6.

Figure 4:
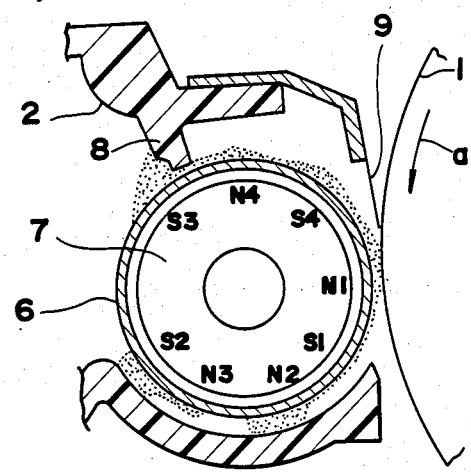
FIG. 4 is a fragmentary sectional view showing another embodiment of the invention.

Although the embodiment described above has one magnetized portion including the poles S2 and S3 of the same polarity, this is not limitative. As seen in FIG. 4, the magnetic roller 7 may have two magnetized portions each having poles of the same polarity, i.e., a portion with poles S2, S3 and another portion with poles N2, N3, such that the poles S2 and N2, each positioned upstream of the other in the pair with respect to the direction of transport of the developer, that is, to the direction of rotation of the developing sleeve, are opposed to the casing 3.

In this case, the developer is retained between the sleeve 6 and the casing 3 at two positions, whereby the toner can be more effectively prevented from spilling.

Figure 5:
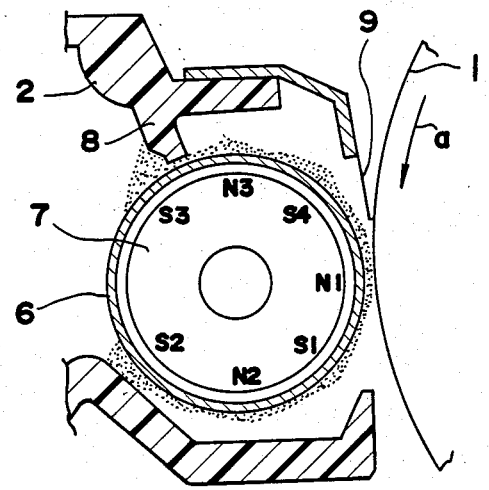
FIG. 5 is a fragmentary sectional view showing another embodiment of the invention.

Further although the casing 3 has a circular-arc form concentric with the developing sleeve 6 as seen in FIG. 1 according to the foregoing embodiment, the casing 3 is not limited to this shape but can be shaped as shown in FIG. 5.

Further although the developing sleeve is covered with the casing from below according to the foregoing embodiment, the casing can be provided at any location insofar as it is disposed downstream from the position where the developing sleeve is opposed to the electrostatic latent image bearing member, between this position and the position where the sleeve is opposed to the developer supplying means.

As will be apparent from the above description, the developing apparatus of the present invention comprises a magnetic roller housed in a developing sleeve and having at least one magnetized portion including adjacent poles of the same polarity. The magnetic roller is formed with N and S poles extending axially thereof, arranged in its outer peripheral portion circumferentially thereof and including these adjacent poles. At least one of the poles of the magnetized portion is opposed to the casing of the developing apparatus, between the position where the developing sleeve is opposed to an electrostatic latent image bearing member and the position where the sleeve is opposed to a developer agitating roller. The other pole is adjacent to and has the same polarity as the one pole and is positioned downstream from the pole with respect to the direction of rotation of the sleeve.

Consequently, the upstream pole of the magnetized portion acts to retain a portion of developer between the developing sleeve and the casing, whereby the toner is prevented from spilling over the casing.

This obviates the likelihood that scattering toner will stain the neighboring devices or adhere to the latent image bearing member to produce fog, spots or the like on the copy images to be obtained.

Moreover, the invention can be embodied merely by shifting a pole or poles of the magnetic roller of an existing developing apparatus without the necessity of changing the mechanical structure thereof and therefore without entailing an increased cost.

What is claimed is:

1. An electrostatic latent image developing apparatus comprising:

a developing sleeve drivingly rotatable for supplying a magnetic developer to the image bearing surface of an electrostatic latent image bearing member;

developer supplying means opposed to the developing sleeve for supplying the developer to the developer carrying surface of the developing sleeve;

a casing provided adjacent to said developing sleeve and extending from a point downstream of a position where the sleeve surface is opposed to the surface of the image bearing member with respect to the direction of rotation of the developing sleeve to a position in the vicinity where the sleeve surface is opposed to the developer supplying means with respect to the direction of rotation of the developing sleeve and defining a gap between the casing and the developing sleeve at said position in the vicinity where the sleeve surface is opposed to the developer supplying means with respect to the direction of rotation of the developing sleeve; and a magnet fixedly positioned within the developing sleeve and having a plurality of N and S poles spaced around said magnet and each pole extending parallel to the axis of said sleeve, said poles including a first pole opposed to the casing and a second pole having the same polarity as said first pole and positioned adjacent to said first pole at the downstream side thereof with respect to the direction of rotation of the developing sleeve, the magnet having no poles between said first and second poles and said first and second poles being spaced sufficiently to leave a portion of said sleeve therebetween where there is substantially no magnetic force in order to form at said first pole the bristle of the developer higher than the size of the gap between the casing and the developing sleeve to seal the gap therebetween.

2. An electrostatic latent image developing apparatus as claimed in claim 1 wherein the pole opposed to the casing is provided at a position where the casing is most proximate to the developing sleeve.

3. An electrostatic latent image developing apparatus as claimed in claim 1 wherein the casing is disposed downstream from a position where the sleeve surface is opposed to the surface of the image bearing member with respect to the direction of rotation of the sleeve.

4. An electrostatic latent image developing apparatus as claimed in claim 3 further comprising a toner confining means upstream from the position where the sleeve surface is opposed to the surface of the image bearing member with respect to the direction of rotation of the sleeve, said toner confining means being a plate means for preventing the developer released from around the developing sleeve from scattering upward.

* * * * *